United States Patent [19]

Caradot

[11] Patent Number: 4,676,688

[45] Date of Patent: Jun. 30, 1987

[54] SELF-CONTAINED MOBILE CRUSHING STATION

[75] Inventor: Patrice Caradot, Saint Etienne, France

[73] Assignees: Razel Freres SA; Societe De Material De Manutention Et De Concassage S2MC, both of France

[21] Appl. No.: 733,131

[22] Filed: May 10, 1985

[30] Foreign Application Priority Data

May 10, 1984 [FR] France ..... 84 07821

[51] Int. Cl.[4] ..... E01C 23/12

[52] U.S. Cl. ..... 404/91; 404/96; 414/504; 198/308.1; 198/861.4

[58] Field of Search ..... 404/90–92, 404/96, 101, 108; 198/308, 316, 318, 511, 522, 592, 861.4; 414/504

[56] References Cited

U.S. PATENT DOCUMENTS

| | | | |
|---|---|---|---|
| 1,938,755 | 12/1933 | Swearinger | 404/91 |
| 2,575,729 | 11/1951 | Radakovich | 414/504 X |
| 3,219,388 | 11/1965 | Haynes | 404/91 X |
| 3,510,073 | 5/1970 | Mailliard | 404/91 |
| 3,828,859 | 8/1974 | Alvarez | 404/92 X |
| 3,843,274 | 10/1974 | Gutman et al. | 404/91 |
| 3,984,015 | 10/1976 | Sidelnikov et al. | 198/511 |
| 4,011,023 | 3/1977 | Cutler | 404/91 |
| 4,037,981 | 7/1977 | Wirtgen | 404/91 |
| 4,272,212 | 6/1981 | Bauer, Jr. et al. | 404/91 X |

*Primary Examiner*—Stephen J. Novosad
*Assistant Examiner*—John F. Letchford
*Attorney, Agent, or Firm*—Remy J. VanOphem

[57] ABSTRACT

A mobile apparatus which, at a front portion, removes the asphalt top surface and the underlayer of a road and crushes the removed materials to reutilize the crushed materials for redistribution of the crushed material along the road surface at the rear of the mobile apparatus. The apparatus includes a frame equipped with a self-propelled drive assembly. The frame is further equipped with an adjustable shovel, a lift conveyor and a crusher station. The apparatus continuously recovers and processes both an asphalt layer and an underlayer of a road for use as an underlayer in the reconstruction of the road surface.

6 Claims, 3 Drawing Figures

SELF-CONTAINED MOBILE CRUSHING STATION

BACKGROUND OF THE INVENTION

1. Field of the Invention

The present invention pertains to a wheel or track type self-contained mobile crushing station which is designed to process the asphalt layer as well as the underlayer of a road, and to crush the materials thus obtained, in order to provide an underlayer for the road to be repaired.

2. Description of the Prior Art

In order to recover the asphalt and the underlayer of roads to be repaired, the following process is generally used.

The asphalt top and the underlayer are broken with an hydraulic or mechanical shovel, or any other means, then loaded in a dump truck by means of a bucket loader, and carried to a crushing station. This material is crushed in a crushing mill and transported again to the work site, to be spread along the road or used for any other purpose.

Such a method presents obvious disadvantages. The processing of the retrieved material requires the use of three different pieces of equipment. The energy consumption is significant. The number of personnel assigned to this task is relatively high since several machine operators are required.

The cost of such a process is, therefore, significant and reduces the efficiency of the recycling of the product on-site.

SUMMARY OF THE INVENTION

In order to eliminate these disadvantages, the present invention proposes an entirely self-contained machine performing the various functions required to retrieve the material at the site, feed the crusher station and crush the retrieved material, as well as spread it along the road or transfer it to other auxiliary equipment.

The present invention relates to an apparatus which includes a track or wheel type frame equipped with a generator, such as a diesel unit.

In front of the frame, a mechanical shovel is provided whose width allows it to penetrate deep enough and lift both the asphalt top and the underlayer of a road surface. This mechanical shovel is jointed in the back and may pivot by the use of hydraulic cylinders. Teeth, made of a corrosion resistant alloy, are provided on the front portion of the mechanical shovel.

The mechanical shovel is loaded by a forward thrust of the rolling member, tracks, or wheels, of the crushing station.

By means of its jointed connection, the mechanical shovel may, whenever required, lift the front portion along with the road layer under which it has penetrated and thereby break up the underlayer and asphalt top road layer.

The rear end of a bulk conveyor is provided under the rear portion of the mechanical shovel, and is properly oriented for the material lifted by the mechanical shovel to fall on the bulk conveyor. The bulk conveyor is tilted and its front portion is located above the "throat" provided to feed a crusher located at the rear of the machine frame.

The conveyor used will desirably be a flight drag chain conveyor, due to the significant incline required to feed the upper portion of the crusher. It is also possible to use a metal table conveyor or a belt conveyor. In this case, the belt will be equipped with ridges or other known features designed to assist in the ascent of the material carried.

The crusher will preferably be an impact grinder including a housing with wear protection, a high speed (about 40 m/s) wheel impeller with several buckets, adjustable jointed anvils with wear protection coating, and auxiliary attachments.

The invention also includes another type of crusher, namely with jointed hammers, with one or several tooth or toothless cylinders, which have stationary or rotating jaws, depending on the crushed material quality desired.

Due to the fact that the discharge width of the crusher station is generally smaller than the width of the mechanical shovel, and also considering the crushed material bulk factor, a crushed material distribution device is provided at the discharge portion of the crusher station. The crushed material distribution device is required in order to obtain a layer of desired thickness spread behind the machine. This device may also be a conveyor designed to feed the auxiliary equipment, such as mixers, sifters, or the like.

Due to the convexity of the roads, or the curve incline, an additional feature has been provided, namely a position adjustment. This feature is provided by a support member supporting a beam upon which the crusher feed conveyor and the mechanical shovel is mounted. This support member may consist of either a ball joint or a roller bearing ring or any other support member which permits universal movement of the beam relative to the support member. Hydraulic cylinders provide for the beam tilt adjustment and, therefore, the operating depth of the shovel, and further provide for the lateral tilt adjustment or positioning of the beam.

The proposed equipment complies with the legal road clearances, namely 4,300 mm, in order to be operated under bridges. According to another feature of the invention, the upper members which are located more than 3,500 mm above the ground, are collapsible so as to comply with road clearances when the machine is transported on the bed of a trailer.

BRIEF DESCRIPTION OF THE DRAWING

The attached, schematic drawings will give a better understanding of the invention.

DETAILED DESCRIPTION OF THE PREFERRED EMBODIMENT

Figure 1:
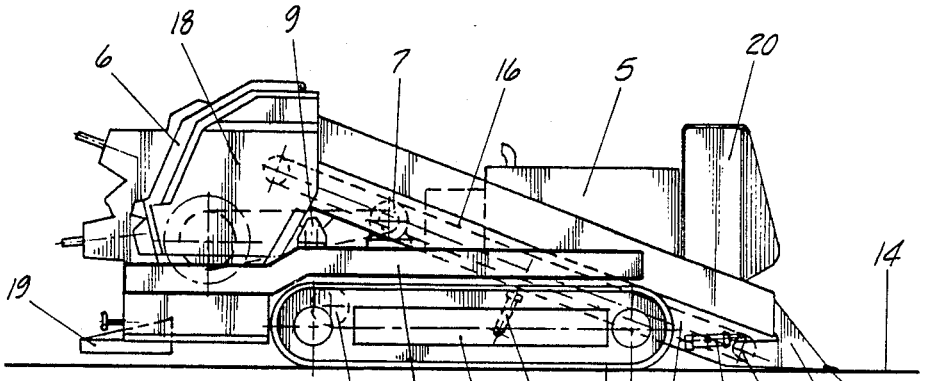
FIG. 1 is an elevational view of the machine according to the invention.

FIG. 1 illustrates a frame 1 of a machine according to the present invention, rigidly mounted to a self-propelled drive assembly 2 which includes a set of tracks 3 driven by hydraulic motors 4 that are powered by an hydraulic diesel power plant 5.

A crusher station 6, driven by an hydraulic or electric motor 7, is provided at a rear portion of the frame 1.

Attached to the frame 1 is a longitudinal beam 8 which is mounted and jointed on the frame 1 by means of a fixed member 9, a ball-joint in this case. Two cylinders 10, preferably hydraulic, are mounted on the beam 8 and frame 1 and define a support triangle for the longitudinal beam. Equal displacement of the two cylinders 10 controls the inclination of the beam 8 from front to rear or longitudinally. Unequal displacement of the two cylinders 10 modifies the tilt of the beam in the transverse direction. In front of the machine, the beam 8 carries a shovel 11 which articulates about an axis 12 perpendicular to the longitudinal axis of the beam 8, so that a front edge 13 of the shovel 11 may dig under a surface 14 of the road.

The inclination of the shovel 11 may be adjusted by means of two cylinders 15, preferably hydraulic, located on either side of the shovel 11 and attached to the beam 8.

Behind the shovel 11, the beam 8 carries a lift conveyor 16 designed to receive the materials lifted by the shovel 11.

In the preferred embodiment, the lift conveyor 16 includes a flight drag chain conveyor powered by an hydraulic motor 17. The lift conveyor 16 feeds an upper opening 18 of the crusher station 6. In order to spread the crushed material discharged by the crusher station 6, a plowshare or spreader 19 is provided beneath the crusher station 6.

In front, the machine is equipped with an operator's cab 20 located in the immediate vicinity of the shovel 11.

Figure 2:
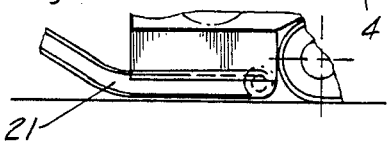
FIG. 2 is a partial cut away view of a variation of the machine illustrated in FIG. 1.

FIG. 2 illustrates a variation of the machine according to the invention. A conveyor 21 is located under the discharge of the crusher station 6 to carry the crushed materials to other processing equipment.

Figure 3:
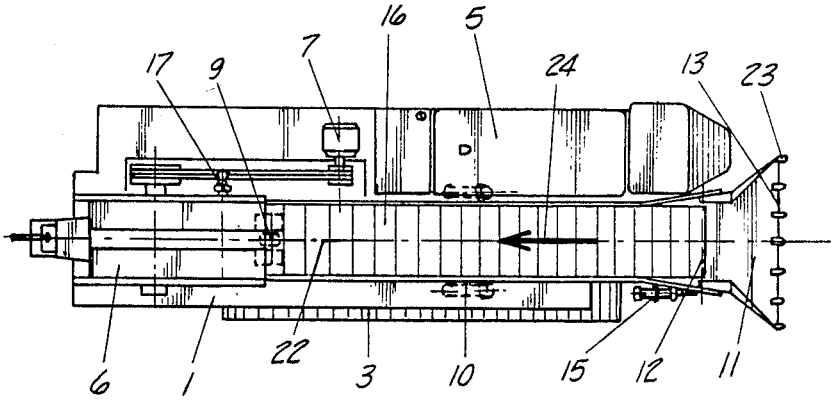
FIG. 3 is a plan view of the machine depicted in FIG. 1.

FIG. 3 is a plan view of the machine illustrated in FIG. 1. The fixed member or ball-joint 9 is located on a longitudinal axis 22 of the beam 8, of the lift conveyor 16 and of the shovel 11. The two cylinders 10 are located on either side of the longitudinal axis 22, preferably at equal distances therefrom. Teeth 23, made of corrosion resistant material, are provided at the front of the shovel 11. The materials lifted by the front of the shovel 11 are directed as indicated by an arrow 24 onto the lift conveyor 16 and then to the crusher station 6.

The advantages of the machine of the present invention clearly appear in the description herein and in the attached drawings.

A single machine is used to lift the asphalt top surface and the underlayer, to transport the materials to the crusher station, crush them and spread them along the road or dispatch them to auxiliary equipment for processing.

The time, personnel, and energy savings are significant. There is no need to transport the material by truck to a semi-mobile crushing station required to follow the movement of the work site activities.

The material obtained from the asphalt surface and the underlayer is recycled. This represents a significant time savings and eliminates the need for an elevation of the road level which causes road clearance problems under bridges.

Because the position and tilt of the shovel are adjustable, the machine is easily adapted to any road surface. Depending on the thickness of the underlayer to be processed, the machine may, therefore, progress several hundred meters per day.

Although the best mode contemplated by the inventor for carrying out the present invention as of the filing date hereof has been shown and described herein, it will be apparent to those skilled in the art that suitable modifications, variations, and equivalents may-be made without departing from the scope of the invention, such scope being limited solely by the terms of the following claims.

What is claimed is:

1. A self-contained machine for simultaneously removing an existing top and underlayer surface material of an asphalt road surface at one end of said self-contained machine and processing the removed material for redistribution of the processed material at another end of the self-contained machine as a base material for a new asphalt road surfce to be built, said self-contained machine comprising:

a frame having a front portion and a rear portion;

means for conveying said frame along the road surface, said means for conveying being mounted to said frame and further being selectively operable for movement of said self-contained machine along the road surface;

means for removing and conveying the material removed at said one end of said self-contained machine to said another end of said self-contained machine, said removing and conveying means being mounted to said frame, said removing and conveying means further comprising:

a longitudinal beam having one end and an opposite end, said opposite end of said longitudinal beam being mounted to said frame;

universal joint means interposed said opposite end of said longitudinal beam and said frame;

means for selectively tilting said longitudinal beam in a transverse and a longitudinal direction, said means for selectively tilting interposed said longitudinal beam and said frame at a point intermediate said one end and said opposite end of said longitudinal beam;

a shovel member pivotally connected to said one end of said longitudinal beam; and means for articulating said shovel member relative to said one end of said longitudinal beam such that as said means for selectively tilting said longitudinal beam is actuated to align said shovel member with the road surface in a transverse direction, said shovel member is articulated in a longitudinal direction to align with the asphalt surface of the road from which said material is to be removed;

means for crushing the material of the road surface, said means for crushing being mounted to said rear portion of said frame adjacent to said means for removing and conveying, said means for crushing being selectively operable to crush the material of said road surface for reuse as a base material for a new road surface to be built, said means for crushing further comprising means for discharging the base material from said another end of said self-contained machine.

2. The self-contained machine as claimed in claim 1 wherein said means for selectively tilting said longitudinal beam further comprises:

a first pair of hydraulic cylinders interposed said frame and said longitudinal beam at a location between said one end and said opposite end of said longitudinal beam, each of said first pair of hydraulic cylinders being selectively operable to tilt said longitudinal beam in said transverse and said longitudinal direction; and means for selectively operating each of said first pair of hydraulic cylinders to tilt said longitudinal beam, said means for selectively operating said first pair of hydraulic cylinders being positioned at said one end of said frame.

3. The self-contained machine as claimed in claim 1 wherein said means for articulating said shovel member relative to said one end of said longitudinal beam further comprises:

a second pair of hydraulic cylinders interposed said longitudinal beam and said shovel member, said second pair of hydraulic cylinders being selectively operable to adjust the inclination of said shovel member relative to said longitudinal beam; and means for selectively operating said second pair of hydraulic cylinders to adjust the inclination of said shovel member, said means for selectively operating said second pair of hydraulic cylinders positioned at said one end of said frame.

4. The self-contained machine of claim 1 wherein said means for conveying said frame along the road surface comprises:

a pair of tracks movably mounted to said frame, said pair of tracks being movable for travel of said self-contained machine along the road surface; and means for propelling said pair of tracks, said means for propelling mounted to said frame, said means for propelling further being selectively operable to move said self-contained machine along the road surface.

5. The self-contained machine of claim 1 wherein said means for removing and conveying further comprises:

an endless conveyor member movably mounted to said longitudinal beam, said endless conveyor member being adapted to transport the material removed by said means for removing and conveying from said shovel member to said means for crushing; and hydraulic motor means for powering said endless conveyor member, said hydraulic motor means being mounted to said frame, said hydraulic motor means being selectively operable to move said endless conveyor member for conveying the material removed by said means for removing said conveying from said shovel member to said means for crushing.

6. The self-contained machine as claimed in claim 1 wherein said means for discharging further comprises:

a plowshare member mounted to said rear portion of said frame, said plowshare member positioned for spreading the base material for a new road surface.

* * * * *

UNITED STATES PATENT AND TRADEMARK OFFICE

CERTIFICATE OF CORRECTION

PATENT NO. : 4,676,688

DATED : June 30, 1987

INVENTOR(S) : Patrice Caradot

It is certified that error appears in the above-identified patent and that said Letters Patent is hereby corrected as shown below:

In The Specifications

Column 2, line 51, after "away" insert ---- elevational ----.

Column 2, line 68, delete "on" and insert ---- to ----.

In The Claims

Column 4, line 11, delete "surfce" and insert ---- surface ----.

Column 4, line 25, kindly insert a paragraph indention.

Column 4, line 28, kindly insert a paragraph indention.

Column 4, line 30, kindly insert a paragraph indention.

Column 4, line 36, kindly insert a paragraph indention.

Column 4, line 38, kindly insert a paragraph indention.

Signed and Sealed this

Third Day of November, 1987

*Attest:*

DONALD J. QUIGG

*Attesting Officer*

*Commissioner of Patents and Trademarks*